US009616440B2

(12) United States Patent
Dietrich et al.

(10) Patent No.: US 9,616,440 B2
(45) Date of Patent: Apr. 11, 2017

(54) ELECTRODE HOLDER AND JET NOZZLE FOR A POWDER SPRAY GUN OPERABLE AT HIGH VOLTAGE

(71) Applicant: J. WAGNER AG, Altstatten (CH)

(72) Inventors: Hanspeter Dietrich, Ruthi (CH); Rene Schmid, Hinterforst (CH); Gilbert Lutz, Kriessern (CH); Kurt Seitz, Widnau (CH); Urban Bischofberger, Kriessern (CH); Patrik Studerus, Steinach (CH)

(73) Assignee: J. Wagner AG, Altstatten (CH)

( * ) Notice: Subject to any disclaimer, the term of this patent is extended or adjusted under 35 U.S.C. 154(b) by 311 days.

(21) Appl. No.: 13/792,556

(22) Filed: Mar. 11, 2013

(65) Prior Publication Data

US 2013/0240646 A1 Sep. 19, 2013

(30) Foreign Application Priority Data

Mar. 14, 2012 (EP) ..... 12 405 028

(51) Int. Cl.
*B05B 5/053* (2006.01)
*B05B 5/03* (2006.01)

(52) U.S. Cl.
CPC ..... *B05B 5/0533* (2013.01); *B05B 5/032* (2013.01)

(58) Field of Classification Search
CPC ..... B05B 5/0533; B05B 5/032; B05B 5/025; B05B 5/043; B05B 5/0536; B05B 5/00–5/1691
USPC ..... 239/690–708
See application file for complete search history.

(56) References Cited

U.S. PATENT DOCUMENTS

| | | | | |
|---|---|---|---|---|
| 5,922,131 | A * | 7/1999 | Haas | 118/629 |
| 6,276,618 | B1 * | 8/2001 | Yanagida et al. | 239/693 |
| 6,375,094 | B1 * | 4/2002 | Schroeder et al. | 239/113 |
| 6,478,242 | B1 * | 11/2002 | Knobbe et al. | 239/690 |
| 6,796,519 | B1 | 9/2004 | Knobbe et al. | |
| 7,748,651 | B2 * | 7/2010 | Amari et al. | 239/690 |
| 2007/0063077 | A1 * | 3/2007 | Keudell et al. | 239/690 |
| 2012/0298775 | A1 * | 11/2012 | Hiemer | B01F 5/0641 239/304 |

FOREIGN PATENT DOCUMENTS

| | | |
|---|---|---|
| EP | 1 084 759 A1 | 3/2001 |
| EP | 1 752 224 A2 | 2/2007 |

OTHER PUBLICATIONS

European Search Report for corresponding European Application No. EP 12 40 5028 dated Jul. 23, 2012.

* cited by examiner

*Primary Examiner* — Arthur O Hall
*Assistant Examiner* — Juan C Barrera
(74) *Attorney, Agent, or Firm* — Renner, Otto, Boisselle & Sklar, LLP

(57) ABSTRACT

The electrode holder for a powder spray gun operable at high voltage includes a powder channel and a web, arranged in the powder channel, for holding a high-voltage electrode. In addition, an annular groove arranged concentrically with the powder channel is provided and is open on the downstream side. A labyrinth for the high voltage is formed by the annular groove together with an annular web of a cap nut, the annular web protruding into the annular groove and said cap nut being used to lock the electrode holder.

16 Claims, 9 Drawing Sheets

ELECTRODE HOLDER AND JET NOZZLE FOR A POWDER SPRAY GUN OPERABLE AT HIGH VOLTAGE

TECHNICAL FIELD

The invention relates to an electrode holder and a jet nozzle for a powder spray gun operable at high voltage and also to a powder spray gun comprising an electrode holder and a jet nozzle.

In the case of electrostatic powder coating, the workpiece to be coated is covered by a layer of electrostatically charged powder in a first process step using a powder spray gun. In a subsequent process step, the workpiece coated with the powder is heated until the powder on the surface of the workpiece melts and a closed layer is formed. Once the workpiece has cooled, this layer is a closed protective layer adhering fixedly to the workpiece. An electrode holder with an electrode under high voltage is located in the powder spray gun so that the powder can be electrostatically charged. The powder flows past the electrode and in so doing is electrostatically charged. The high voltage applied to the electrode is generally between 20 kV and 80 kV.

During operation, an explosive powder cloud may potentially be produced in the surrounding environment of the powder spray gun. Various national and international standards stipulate that the powder spray gun must not present an explosion risk. Ignitable partial discharges (discharges in the ionised air) and/or ignitable flashovers (discharges to a much lower potential or to earth) therefore have to be prevented. Partial discharges and flashovers may occur if a distance dependant on the level of the high voltage and the field strength present is undershot.

Generally, with a powder spray gun, various parts can be removed by hand, that is to say without the aid of a tool. These parts will be referred to hereinafter as manually detachable parts. These parts are therefore manually detachable because maintenance operations, such as cleaning operations, can thus be carried out quickly and easily. The manufacturer of the spray gun stipulates that the powder spray gun may only be operated in the assembled state. If, however, the powder spray gun is operated without the manually removable parts, the level of protection is to be maintained nevertheless.

PRIOR ART

An electrode holder for a powder spray device is known from the prior art document EP 1 752 224 B1. The electrode holder has a powder channel and a web, arranged in the powder channel, for holding an electrode. The upstream portion of the powder channel is formed as a socket, into which a powder tube can be slid. In addition, an electrical contact is provided, which is arranged on the upstream end face of the socket.

Disclosure of the Invention

The object of the invention is to specify an electrode holder and a jet nozzle for a powder spray gun operable at high voltage as well as a powder spray gun comprising an electrode holder and a jet nozzle, wherein it is ensured that the powder spray gun poses no risk to the user, both in the assembled state and in the disassembled state. Here, the disassembled state is understood to mean a state in which the manually detachable parts, that is to say the parts that can be detached without a tool, are removed.

As a result of the invention, there is advantageously no explosion risk posed by the gun.

The object is achieved by an electrode holder for a powder spray gun operable at high voltage having the features disclosed herein.

The electrode holder according to the invention for a powder spray gun operable at high voltage comprises a powder channel and a web, arranged in the powder channel, for holding a high voltage electrode. In addition, an annular groove arranged concentrically with the powder channel is provided and is open on the downstream side. A labyrinth for the high voltage is formed by the annular groove together with an annular web of a cap nut, said annular web protruding into the annular groove and said cap nut being used to lock the electrode holder.

The object is also achieved by an electrode holder for a powder spray gun operable at high voltage having the features disclosed herein.

The electrode holder according to the invention for a powder spray gun operable at high voltage comprises a powder channel and a web, arranged in the powder channel, for holding a high-voltage electrode. In addition, a snap-in groove is provided outside the powder channel in order to form a snap-fit connection together with a snap-in hook of a cap nut, which is used to lock the electrode holder.

The object is also achieved by a spray nozzle for a powder spray gun operable at high voltage having the features specified in disclosed herein.

The jet nozzle according to the invention for a powder spray gun operable at high voltage has a powder channel, which discharges on the downstream side into a nozzle opening. In addition, a radially outwardly open snap-in groove is provided in order to form a snap-fit connection together with a snap-in hook of a cap nut, which is used to lock the jet nozzle.

The object is also achieved by a powder spray gun operable at high voltage having the features disclosed herein.

The powder spray gun according to the invention operable at high voltage has one of the above-described electrode holders.

Advantageous developments of the invention will emerge from the features described herein.

In an embodiment of the electrode holder according to the invention, the annular groove has a width and depth such that, when the annular web of the cap nut protrudes into the annular groove, an air gap is formed between the walls of the annular groove and the web.

In a further embodiment of the electrode holder, the snap-in groove is open in a radial direction.

In addition, in the case of the electrode holder, a guide lug extending in the axial direction may be provided on the outer face of the powder channel and the snap-in groove may be recessed into the guide lug. The guide lug may have two different functions. On the one hand, it is used to guide the spray nozzle so that said spray nozzle cannot rotate with respect to the electrode holder. On the other hand, it is used as a counterpiece for the snap-in hook of the cap nut.

In a development of the electrode holder, an axial seal arranged concentrically with the powder channel is provided.

In another development of the electrode holder, an electrically conductive contact ring is provided.

A channel, in which a plurality of resistors are arranged, via which the contact ring is connected to the high-voltage electrode, is advantageously provided in the electrode holder.

In addition, in the case of the electrode holder, a wedge can be provided, which can be fitted onto the upstream end of the web.

The wedge in the electrode holder may have a width of 13.0 to 13.4 mm and preferably 13.2 mm.

Lastly, the wedge in the electrode holder may have a length between 10 and 20 mm. The radius of the wedge is between 10.0 mm and 11.0 mm, preferably 10.4 mm.

In an embodiment of the jet nozzle according to the invention, the snap-in groove is formed such that, when the jet nozzle sits on an electrode holder, which likewise has a snap-in groove, the walls of the snap-in groove in the jet nozzle are not offset axially with respect to the walls of the snap-in groove in the electrode holder.

In a further embodiment of the jet nozzle, a slit, into which a guide lug of the electrode holder protrudes when the jet nozzle sits on the electrode holder, is provided on the upstream side. In addition, the slit extends from the upstream end of the powder channel, beyond the snap-in groove.

Lastly, a displaceable sleeve and a latching mechanism, with which the sleeve can latch on the powder channel, may be provided.

The powder spray gun operable at high voltage comprises an electrode holder as described above and a cap nut with a snap-in hook. The snap-in hook forms a snap-fit connection together with the snap-in groove in the electrode holder.

In the case of the powder spray gun, the snap-in hook of the cap nut may form a snap-fit connection together with the snap-in groove in the jet nozzle.

EMBODIMENTS OF THE INVENTION

Figure 1:
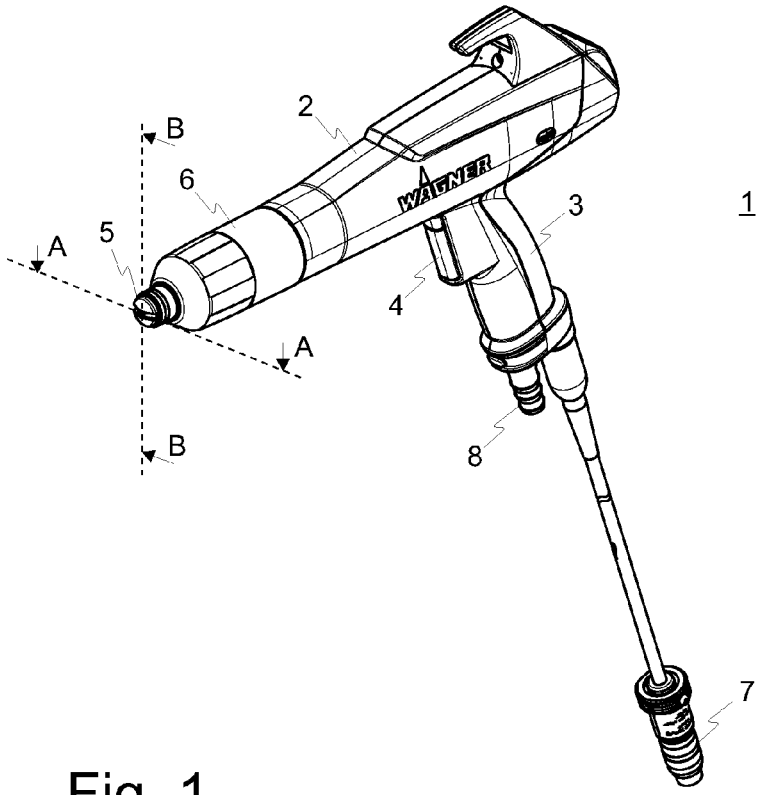
FIG. 1 shows a three-dimensional view of an embodiment of the powder spray gun according to the invention in the assembled state.

FIG. 1 shows a three-dimensional view of a possible embodiment of a powder spray gun 1 according to the invention in the assembled state. Hereinafter, for the sake of simplicity, the powder spray gun 1 will also be referred to as a spray gun or merely as a gun. The spray gun 1 is formed as a manual spray gun and for this purpose comprises a gun housing 2 with a grip 3, via which the operator can hold the gun. The grip 3 has a trigger 4, via which the coating process can be started and stopped. A powder connection 8, via which the gun 1 is supplied with powder, and an electrical connection 7, via which a high-frequency low voltage is supplied to the gun 1, are located at the lower end of the grip 4. A high-voltage generator, which comprises a transformer and a downstream voltage multiplier, is located in the gun 1 and transforms the high-frequency low voltage into a high voltage. Control and information signals can also be fed to the gun via the electrical connection 7 from a control device (not shown in the figure), and control and information signals can also be conveyed from the gun to the control device. As soon as the trigger 4 has been actuated, the coating powder, or powder for short, is sprayed via a spray nozzle 5, which is located at the downstream end of the gun 1. As soon as a high voltage is applied to the electrode 11, the powder P flowing past the electrode 11 is electrostatically charged. The spray nozzle 5 will also be referred to hereinafter as a jet nozzle or nozzle for short. It is fixed by means of a cap nut 6, which is screwed onto the downstream end of the gun 1.

Figure 2:
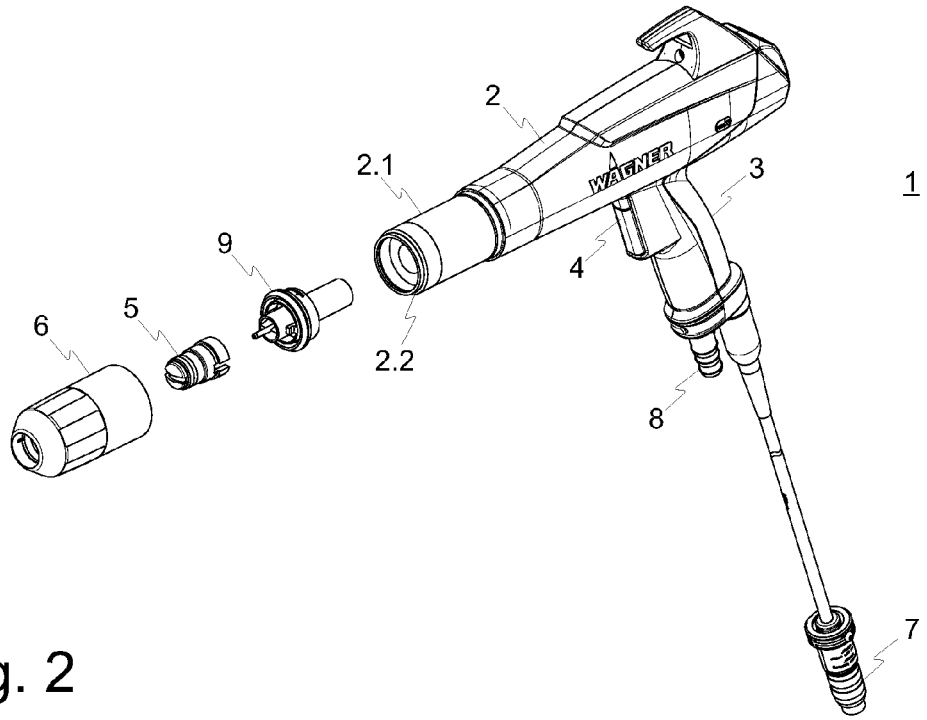
FIG. 2 shows a three-dimensional view of the powder spray gun according to the invention in a partly disassembled state.

FIG. 2 shows a three-dimensional view of the powder spray gun according to the invention in a partly disassembled state. In the embodiment shown in FIGS. 1 and 2, the spray nozzle 1 is formed as a flat jet nozzle. This will be discussed later in greater detail. The downstream portion of the gun 1 comprises a substantially cylindrical housing portion 2.1, which will be referred to hereinafter as the downstream housing portion 2.1. This is formed such that the sleeve-shaped cap nut 6 can be slid over it and screwed thereto. To this end, the downstream housing portion 2.1 has an outer thread 2.2 at its downstream end and the cap nut 6 has a corresponding inner thread.

A socket 2.3, which is part of the housing portion 2.1, is located inside the downstream housing portion 2.1. The socket 2.3 forms a receptacle on the upstream side for a powder tube 14 (see FIG. 4) and forms a receptacle on the downstream side for the powder channel 10 of the electrode holder 9. The stop on the inner face of the socket 2.3 may form the depth stop for the electrode holder 9.

Figure 3:
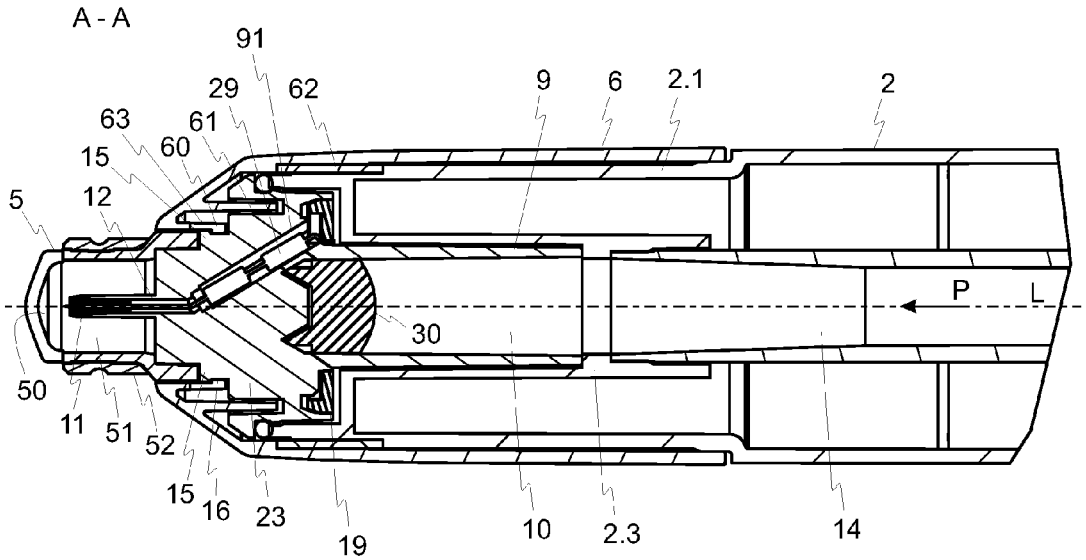
FIG. 3 shows a first longitudinal sectional view of the downstream part of the powder spray gun according to the invention.
Figure 4:
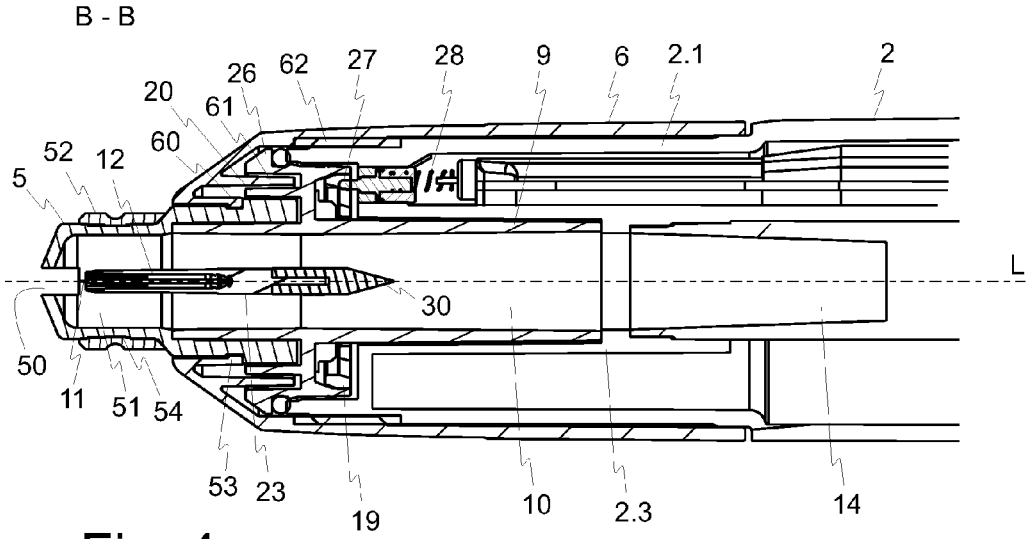
FIG. 4 shows a second longitudinal sectional view of the downstream part of the powder spray gun according to the invention.
Figure 5:
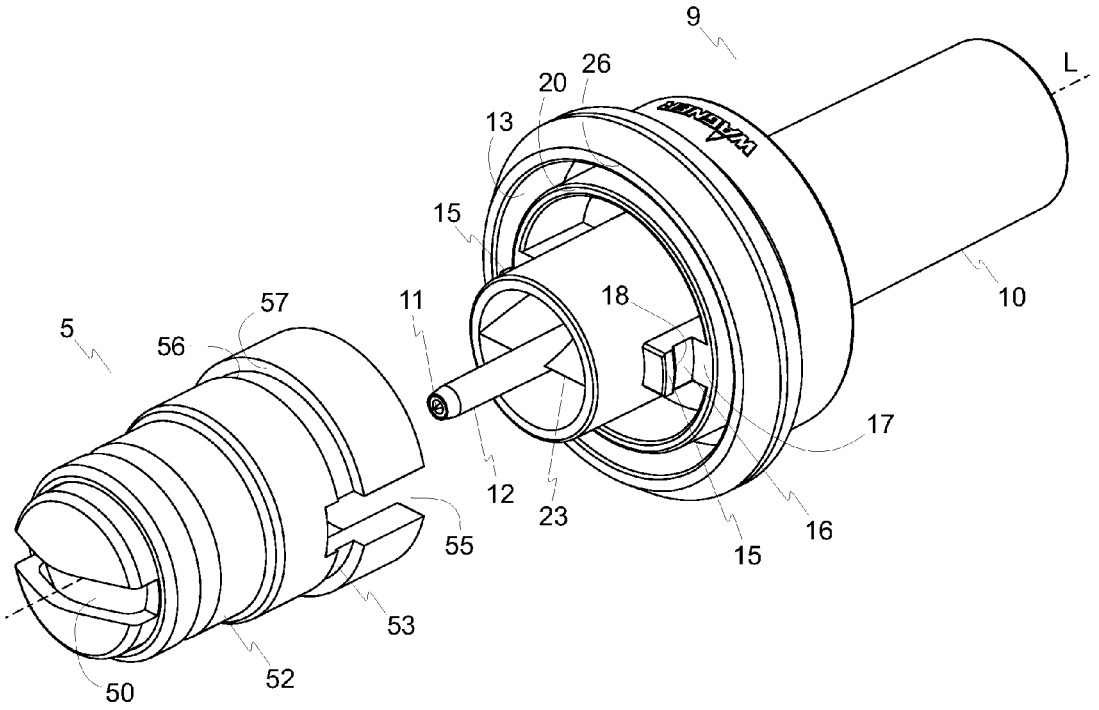
FIG. 5 shows a three-dimensional view of a first embodiment of a jet nozzle according to the invention for the powder spray gun and a three-dimensional view of a first embodiment of an electrode holder according to the invention for the powder spray gun.
Figure 6:
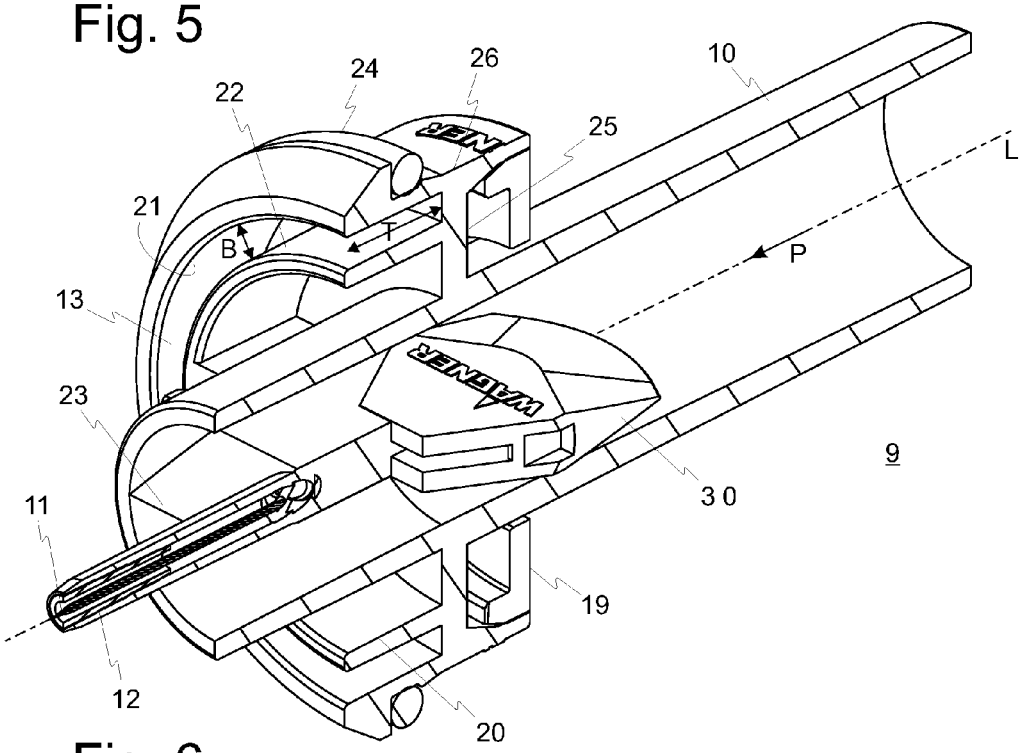
FIG. 6 shows a three-dimensional longitudinal sectional view of the electrode holder according to the invention.

FIG. 3 shows a longitudinal sectional view of the downstream part of the powder spray gun 1 according to the invention along the line of section A-A, and FIG. 4 shows a longitudinal sectional view of the downstream part of the powder spray gun 1 according to the invention along the line of section B-B. FIG. 5 shows a three-dimensional view of a first embodiment of a spray nozzle 5 according to the invention for the powder spray gun 1 and a three-dimensional view of a first embodiment of an electrode holder 9 according to the invention for the powder spray gun 1. FIG. 6 shows a three-dimensional longitudinal sectional view of the electrode holder 9 according to the invention along the line of section B-B. Reference is made to these figures in particular in the following embodiments.

The cap nut 6 is screwed onto the downstream portion of the gun housing 2.1 and has an inner thread 62 in its downstream portion for this purpose. The cap nut 6 tapers conically toward the downstream end. In this portion, an annular web 61, which is arranged concentrically with the longitudinal axis L of the powder channel 14, 10, 51, is located inside the cap nut 6.

The electrode holder 9 has a powder channel 10, which is arranged concentrically with the longitudinal axis L. The electrode holder 9 additionally has a retaining web 23, which is arranged within the powder channel 10. On its upstream side, the retaining web 23 carries a powder wedge 30 and on its downstream side it has an electrode channel 12. A high-voltage electrode 11, which will also be referred to hereinafter as an electrode for short, is located inside the electrode channel 12. The geometry of the retaining web 23 is optimised such that the powder can flow through the powder channel with as little hindrance as possible, and sintering of the powder on the retaining web 23 and the formation of powder clumps are avoided. The retaining web 23 is formed such that the powder wedge 30, or wedge for short, can be fitted onto the retaining web 23 and also removed again. The wedge 30 is optimised in terms of wear in the embodiment shown. There is more material in the centre of the wedge 30, and the edge of the wedge has a convexity with a radius of R=10.4 mm.

The electrode holder 9 additionally has a wall 25, which extends in a radial direction, is supported externally on the powder channel 10 and on its outer face carries an outer ring 26 concentric with the longitudinal axis L. The outer ring 26 is used inter alia to centre the electrode holder 9 in the downstream housing portion 2.1 and seals the interior of the gun housing 2 in a downstream direction. To this end, the outer ring 26 has a stop adjoined on the upstream side thereof by a resilient O-ring 24. The O-ring 24 and the stop thus form an axial seal.

A contact ring 19 made of a conductive material is located on the upstream side of the ring 26 and of the wall 25. For example, a conductive plastic or rubber is suitable for this. The contact ring 19 is connected to the electrode 11 via electrical resistors 29. The resistors 29 are arranged in a channel 91, which passes through the wall 25, the powder channel 10 and the retaining web 23 and discharges into the electrode channel 12. The high-voltage line running inside the gun 1 is guided out from the gun housing 2 at the downstream end and is guided onto a contact pin 27. If the electrode holder 9 is incorporated into the gun 1, the contact pin 27 is pressed by means of a spring 28 against the contact ring 19 of the electrode holder 9 and thus ensures that the high voltage is applied reliably to the contact ring 19. Here, the orientation of the electrode holder 9 is insignificant. This means that the electrode holder 9 can be rotated arbitrarily about its longitudinal axis L and that reliable and fault-free electrical contacting is still ensured.

An inner ring 20 running concentrically with the longitudinal axis L is located on the downstream side of the wall 25. This inner ring, together with the outer ring 26, forms an annular groove 13 of width B and depth T with two opposing side walls formed by the inner wall 21 of the outer ring 26 and the outer wall 22 of the inner ring 20. When the spray gun 1 is assembled, the annular web 61 of the cap nut 6 protrudes into the groove 13 in the electrode holder 9. The geometry of the annular web 61 and of the groove 13 is selected such that a first air gap is formed between the wall 21 of the outer ring 26 and the web 61, and a second air gap is formed between the wall 22 of the inner ring 20 and the web 61. The depth of the web 61 and of the groove 13 is also selected such that an air gap is formed. A labyrinth for the high-voltage is thus produced between the high-voltage electrode 11 and the outer face of the cap nut 6, that is to say an extension of the distance or the air gap.

As can be seen in FIGS. 3 and 5, the electrode holder 9 additionally has, on its downstream side, two lugs 15 extending parallel to the longitudinal axis. A groove 16 for a snap-fit connection, which will also be referred to hereinafter as snap-in groove 16, is located in each of the two lugs 15. In the downstream portion, the cap nut 6 has a correspondingly formed web with snap-in hooks 60. As soon as the electrode holder 9 has been slid in a forward direction into the cap nut 6 until contact is achieved, the snap-in hook 60 of the cap nut 6 latches into the snap-in groove 16 in the electrode holder 9 and thus forms an interlocking connection between the electrode holder 9 and the cap nut 6. The electrode holder 9 is thus fixed in the cap nut 6 in the axial direction. The snap-fit connection is formed such that the electrode holder 9 can still be rotated however in the cap nut 6 about its longitudinal axis L.

In one embodiment, the snap-in hook 60 of the cap nut 6 is formed in an annular manner and has one or more slits 63. The slit or slits 63 extend in the axial direction and interrupt the annular snap-in hook 60. The annular snap-in hook 60 is thus divided into a plurality of segments and the resilient property of the annular snap-in hook 60 is amplified. The width of the slits 63 is advantageously smaller than the width of the guide lugs 15 of the electrode holder 9.

To this end it is also possible, either instead or in addition, to form the ring, which carries the snap-in hook 60, with a thin wall so as to improve the resilient property of the snap-in hook 60.

The two lugs 15 protrude into a slit 55 of the spray nozzle 5. It is thus ensured that the nozzle slit 50 of the spray nozzle always has the same orientation with respect to the retaining web 23 and the wedge 30. If the electrode holder 9 is rotated about its longitudinal axis L, the spray nozzle 5 and the nozzle slit 50 are consequently also rotated, such that the orientation of the nozzle slit 50 with respect to the wedge 30 then also remains the same. This has the advantage that the powder jet is of constant quality (irrespective of the orientation of the nozzle slit 50) and a reproducible powder jet is ensured. The nozzle slit 50 generates a flat spray jet. For this reason, the nozzle 5 will also be referred to as a flat jet nozzle.

The spray nozzle 5 additionally has a snap-in groove 53, which is arranged concentrically with the powder channel 51 of the nozzle 5 and of which the position and width are defined by the two opposing side walls 56 and 57. The slit 55 starts at the upstream end of the spray nozzle 5 and reaches beyond the snap-in groove 53 in the longitudinal direction. The part of the slit 55 reaching beyond the snap-in groove 53 is used to receive the downstream bead of the snap-in lug 15 of the electrode holder 9. As soon as the spray nozzle 5 is slid in a forward direction into the cap nut 6 until contact is achieved, the snap-in hook 60 of the cap nut 6 latches into the snap-in groove 53 in the nozzle 5 and thus forms an interlocking connection between the nozzle 5 and the cap nut 6. The nozzle 5 is thus fixed in the cap nut 6 such that the nozzle can no longer fall out from the cap nut, but can still be rotated in the cap nut 6 about its longitudinal axis L.

Since the nozzle 5 and the electrode holder 9 are fixed in the cap nut 6, both components are detached together with the cap nut 6. The electrode holder 9 is thus removed inclusive of the contact ring 19. The ignition energy, which plays a role for the explosion risk, is thus considerably reduced. The risk of injury to the user is thus further reduced.

In this disassembled state, the powder spray gun 1 is no longer in the intended operating state. Rather, this state is a maintenance state. If the powder spray gun 1 has not also been separated from the powder and voltage supplies, it can still generate a powder jet however. This, however, does not correspond to the powder jet intended for powder coating.

A sleeve 52 displaceable in the axial direction is located on the outer face of the spray nozzle 5. The powder spray angle can be set by means of said sleeve. The further the sleeve 52 is slid toward the downstream end of the spray nozzle 5, the smaller is the angle at which the powder is sprayed. For this reason, the sleeve 52, which latches in a specific position on the spray nozzle 5, has an annular bead on its inner face and the spray nozzle 5 has a corresponding annular indentation 54. The sleeve 52 can thus be fixed on the spray nozzle 5 in a specific, defined position in order to set a specific powder spray angle. As soon as the sleeve 52 latches on the nozzle 5, a reproducible powder spray angle is ensured. A further advantage is that the sleeve 52 is assembled securely on the spray nozzle 5 by means of the latching mechanism.

The latching mechanism can also be formed as follows. Instead of attaching the bead to the sleeve 52 and the indentation to the spray nozzle 5, the bead may also be provided on the spray nozzle 5 and the indentation in the sleeve 52.

Figure 7A:
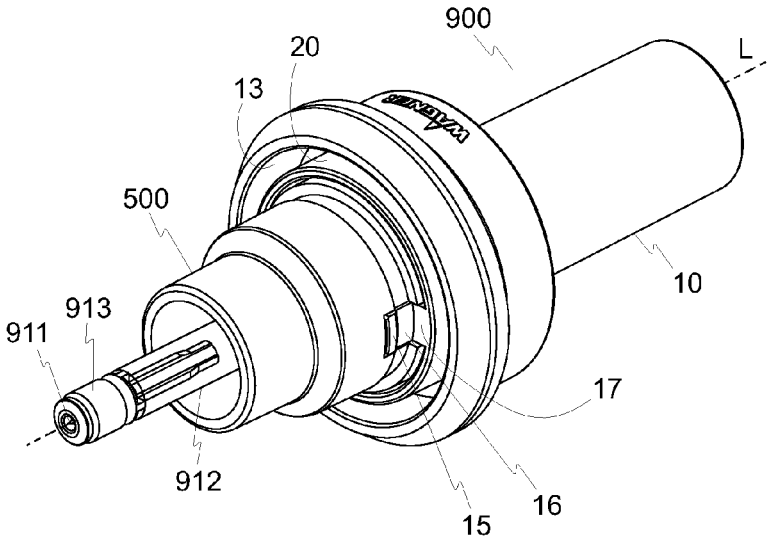
FIG. 7*a* shows a three-dimensional view of a second embodiment of the jet nozzle according to the invention for the powder spray gun in the assembled state and a three-dimensional view of a second embodiment of the electrode holder according to the invention for the powder spray gun in the assembled state.
Figure 18:
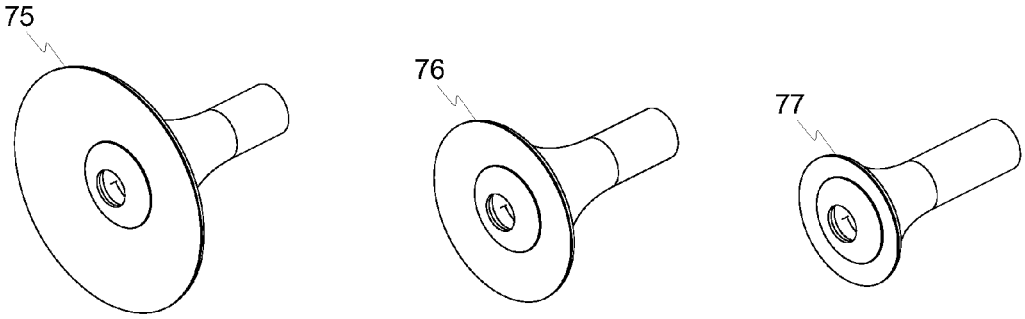
FIG. 18 shows a three-dimensional view of three different embodiments of the baffle plate.

FIG. 7*a* shows a three-dimensional view of a second embodiment of the spray nozzle 500 according to the invention, which is fitted loosely onto a second embodiment of the electrode holder 900 according to the invention. The electrode holder 900 differs from the electrode holder 9 in particular in the formation of the electrode channel 912. The electrode channel 912 is lengthened compared to the electrode channel 12. A receptacle 913 for a baffle plate 75, which can be formed as shown in FIG. 18, is located at the downstream end of said electrode channel.

Figure 7B:
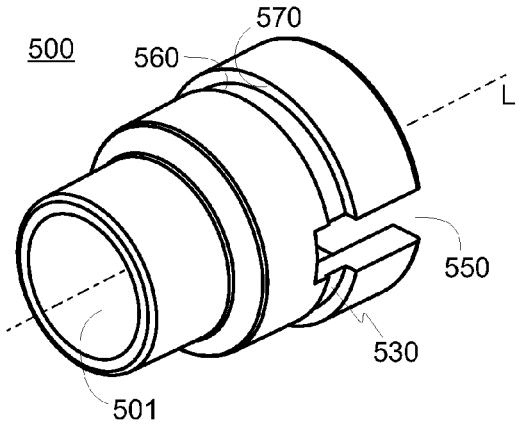
FIG. 7*b* shows a three-dimensional view of the second embodiment of the spray nozzle according to the invention.

The second embodiment of the spray nozzle 500 is not formed as the flat jet nozzle 5 shown in FIGS. 1 to 5, but as a round jet nozzle. The round jet nozzle 500 illustrated in FIGS. 7*a* and 7*b* basically differs from the flat jet nozzle 5 in that the nozzle opening 501 is not slit-shaped, but is round and the nozzle does not carry a sleeve at the downstream portion for setting the spray angle. Instead, the baffle plate 75 shown in FIGS. 13 to 18 adjoins the round nozzle opening 501. In this embodiment a conical powder jet rather than a flat powder jet is generated.

For improved comprehension, only one electrode holder will be discussed hereinafter. The following section relates to all embodiments however of the electrode holders 9 and 900.

Figure 8:
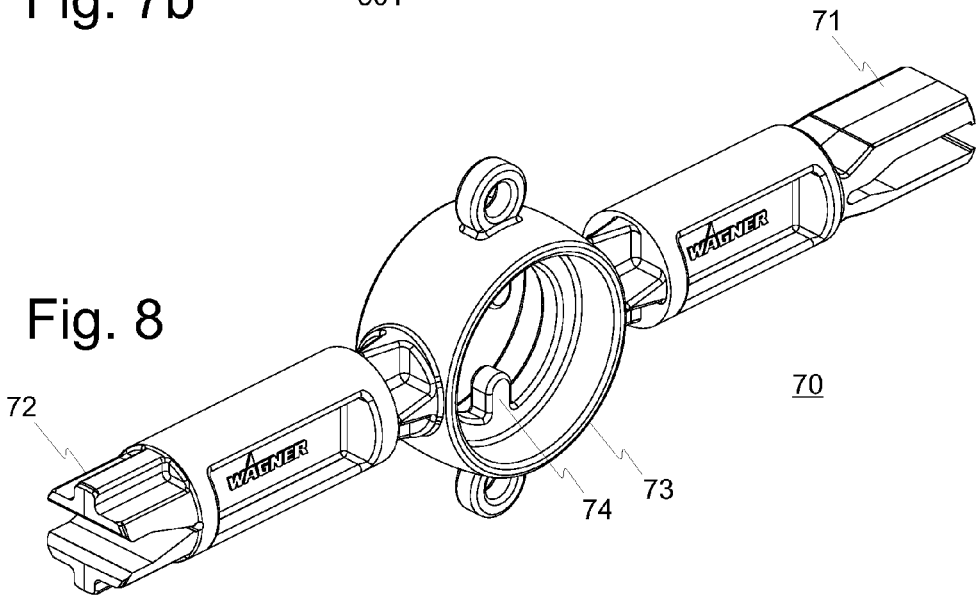
FIG. 8 shows a tool, which is used to remove and fit a wedge located in the electrode holder and to align the jet nozzle.

So as to be able to remove the wedge 30 located in the electrode holder 9 or 900 and so as also to be able to insert the wedge 30 into the electrode holder, a tool 70 is useful, which is formed as shown in FIG. 8. In order to remove the wedge 30, the removal gripper 71 of the tool 70 is slid into the powder channel 10 of the electrode holder from the upstream side until the removal gripper 71 latches the wedge 30. The tool 70 can then be removed together with the wedge 30.

In order to fit a new wedge 30 onto the retaining web 23, the wedge 30 is fitted into the receptacle 72 of the tool 70 and the receptacle 72 is then slid into the powder channel 10 of the electrode holder until the wedge 30 sits fixedly on the retaining web 23. The tool 70 can then be removed again from the powder channel 10.

Figure 12:
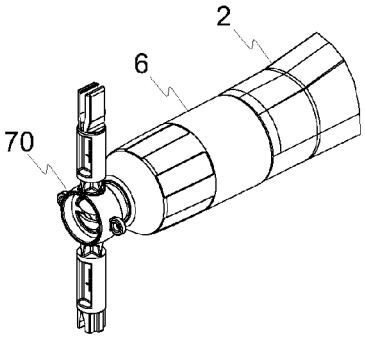
FIG. 12 shows the downstream part of the powder spray gun with the tool fitted onto the jet nozzle.

The tool 70 can also be used to align the flat jet nozzle 5, that is to say to rotate said flat jet nozzle 5. To this end, the tool 70 comprises a receptacle 73 in its centre with a lug 74. In order to rotate the flat jet nozzle 5, the receptacle 73 is fitted onto the flat jet nozzle 5 such that the lug 74 protrudes into the nozzle slit 50. FIG. 12 shows the downstream part of the powder spray gun 1 with the tool 70 fitted onto the spray nozzle 5. In order to rotate the flat jet nozzle 5, the cap nut 6 is first released slightly. As soon as the spray nozzle 5 has been rotated into the desired position, the cap nut 6 is tightened again by hand.

Figure 9:
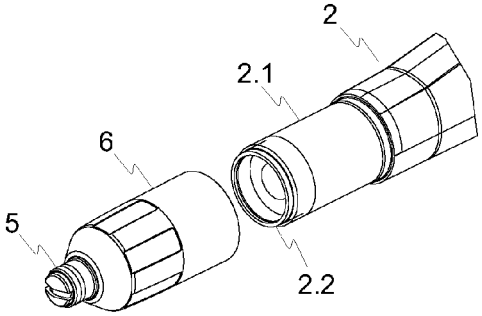
FIG. 9 shows the downstream part of the powder spray gun immediately after unscrewing of the cap nut.

FIG. 9 shows the downstream part of the powder spray gun 1 immediately after unscrewing of the cap nut 6. Due to the snap-fit connections, it is ensured that the flat jet nozzle 5 and also the electrode holder 9 remain in the cap nut 6, that is to say are removed together therewith from the gun 1. So as to then remove the electrode holder 9 and the nozzle 5 from the cap nut, a pressure is exerted onto the nozzle 5 merely in the axial direction. As soon as the force is sufficiently high, the snap-in hook 60 of the cap nut 6 springs out from the snap-in groove 53 in the nozzle 5 and from the snap-in groove 16 in the electrode holder 9. The nozzle 5 and the electrode holder 9 fall out from the cap nut 6. The three component parts can then be cleaned, maintained, checked and, where necessary, one or more components can be replaced.

Figure 10:
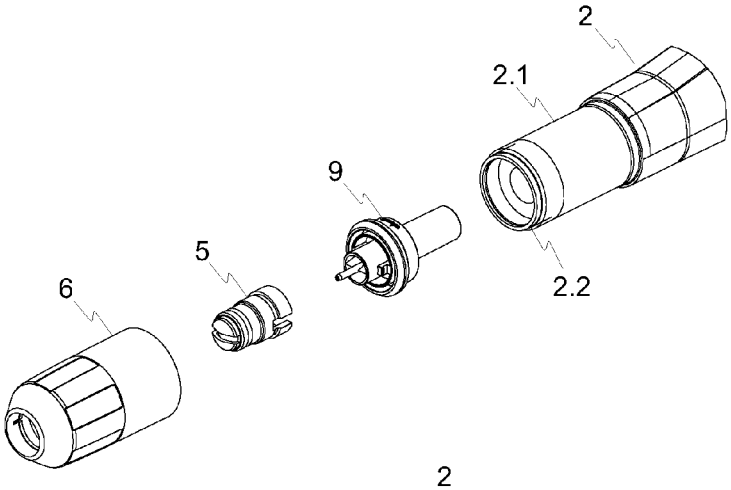
FIG. 10 shows the cap nut, the jet nozzle, the electrode holder and the downstream part of the powder spray gun before assembly.
Figure 11:
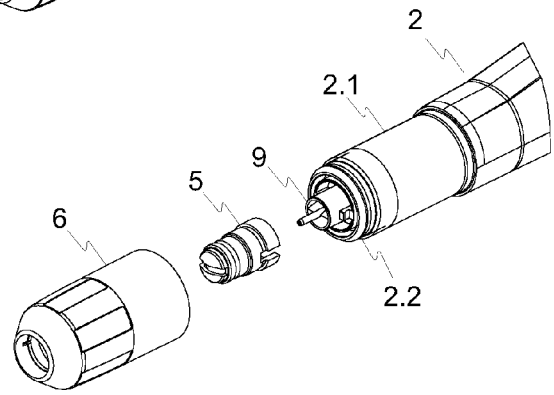
FIG. 11 shows the cap nut, the jet nozzle and the electrode holder inserted loosely into the powder spray gun.

FIG. 10 shows the cap nut 6, the flat jet nozzle 5, the electrode holder 9 and the downstream part of the powder spray gun 1 before assembly. In order to assemble the gun, the electrode holder 9 is generally first fitted into the opening of the spray gun 1 (see FIG. 11). The nozzle 5 is then fitted onto the electrode holder 9. The electrode holder 9 and the spray nozzle 5 are only connected loosely to the gun 1 during this process. The cap nut 6 is then screwed onto the gun 1. As soon as the cap nut 6 has been screwed far enough onto the gun 1, the snap-in hooks 60 of the cap nut 6 latch into the snap-in grooves 53 and 16 in the nozzle 5 and electrode holder 9 respectively. The cap nut 6 is tightened securely by hand. The gun 1 is then ready for operation again.

Figure 13:
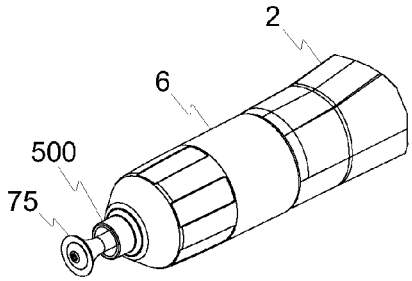
FIG. 13 shows a three-dimensional view of the downstream part of the powder spray gun with a second embodiment of the jet nozzle according to the invention.

FIG. 13 shows a three-dimensional view of the downstream part of the powder spray gun 1 with the second embodiment of the spray nozzle 500 according to the invention.

Figure 14:
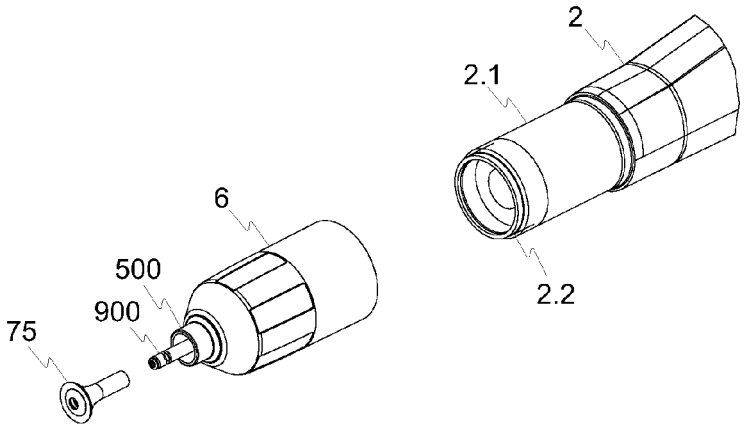
FIG. 14 shows the downstream part of the powder spray gun immediately after unscrewing of the cap nut and removal of the baffle plate.
Figure 15:
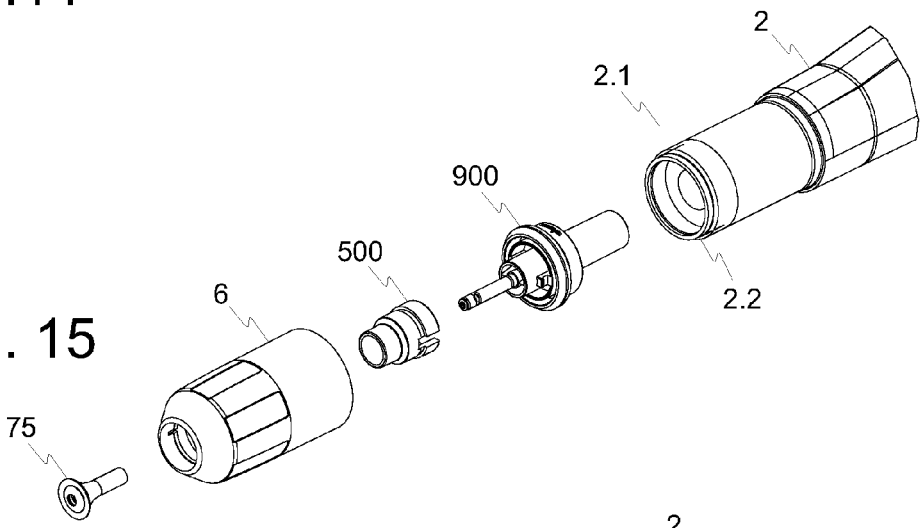
FIG. 15 shows the baffle plate, the cap nut, the jet nozzle, the electrode holder and the downstream part of the powder spray gun before assembly.

In order to then remove the electrode holder 900 and the nozzle 500 from the cap nut 6, the cap nut 6 is first unscrewed from the gun 1 and the baffle plate 70 is removed. FIG. 14 shows the downstream part of the powder spray gun 1 immediately after unscrewing of the cap nut 6 and removal of the baffle plate 70. A pressure is then exerted onto the nozzle 500 in the axial direction. As soon as the force is sufficiently high, the nozzle 500 and the electrode holder 900 fall out from the cap nut 6. FIG. 15 shows the baffle plate 70, the cap nut 6, the jet nozzle 500, the electrode holder 900 and the downstream part of the powder spray gun 1 in the disassembled state or before assembly.

Figure 16:
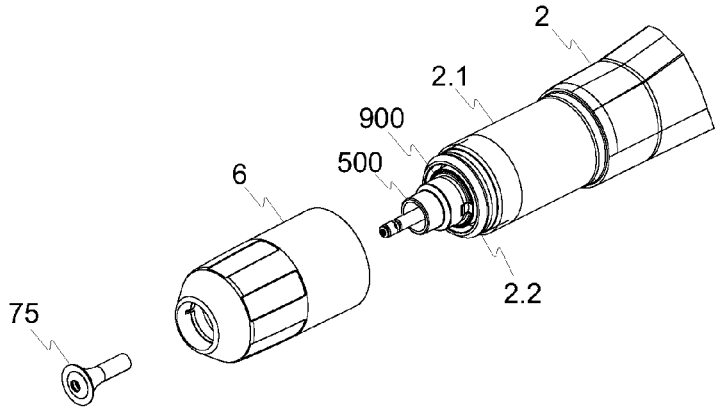
FIG. 16 shows the baffle plate and the cap nut in the unassembled state and the powder gun with a loosely inserted electrode holder and jet nozzle.

FIG. 16 shows the baffle plate 70 and the cap nut 6 in the unassembled state and the powder spray gun 1 with a loosely installed electrode holder 900 and jet nozzle 500. In order to reassemble the gun, the procedure as already described above is carried out.

As an alternative or else initially, the nozzle 500 and the electrode holder 9 may be pressed so securely into the cap nut 6 that they are latched. The cap nut 6 thus equipped can then be screwed onto the spray gun 1. The gun 1 is then ready for operation again.

Figure 17:
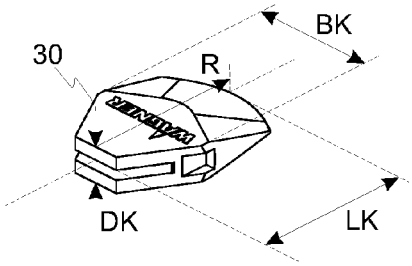
FIG. 17 shows a three-dimensional view of a wedge that can be inserted into the powder channel of the electrode holder.

FIG. 17 shows a three-dimensional view of the wedge 30 insertable into the powder channel 10 of the electrode holder 9 or 900. In a preferred embodiment, the wedge has a length LK of LK=16.9 mm, a width BK of BK=13.2 mm and a thickness DK of DK=3.6 mm. If necessary, the wedge 30 may also be thicker however, for example it may have a thickness DK=3.8 mm. The wedge 30 generally has a thickness DK between 3.2 mm and 4.0 mm.

FIG. 18 shows a three-dimensional view of three different embodiments 75, 76 and 77 of the baffle plate. The three baffle plate 75, 76 and 77 basically differ by the size and the baffle area. The powder jet is flared to the least extent with the baffle plate 77 and is flared to the greatest extent with the baffle plate 75. The baffle plate 75 thus generates a spray cone having the greatest spray angle.

Figure 19:
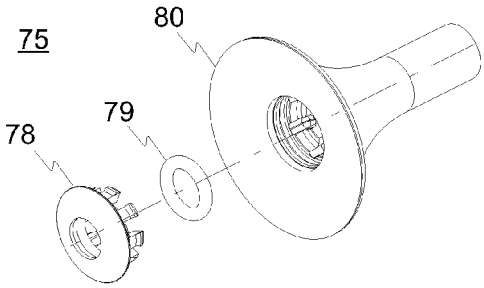
FIG. 19 shows an exploded view of an embodiment of the baffle plate.
Figure 20:
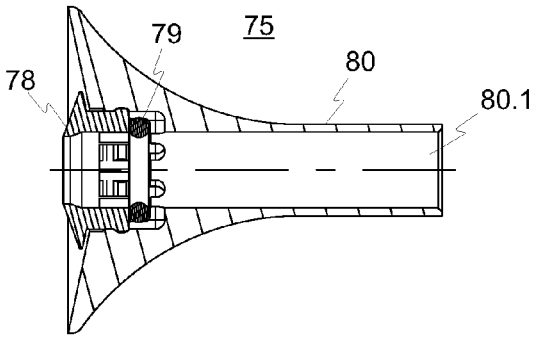
FIG. 20 shows a longitudinal sectional view of the baffle plate.

FIG. 19 shows an exploded view of an embodiment of the baffle plate 75. FIG. 20 shows a longitudinal sectional view of the baffle plate 75. The baffle plate 75 comprises a baffle plate housing 80 with a bore or opening 80.1, which is fitted onto the receptacle 913 of the electrode holder 900. A clamping ring 78 with an O-ring 79 is located at the downstream end of the baffle plate 75. In a possible embodiment, the receptacle 913 of the electrode holder 900 is formed such that the O-ring 79 can latch thereinto. The clamping ring 78 is held in the baffle plate housing 80 via a snap-fit connection.

Figure 21:
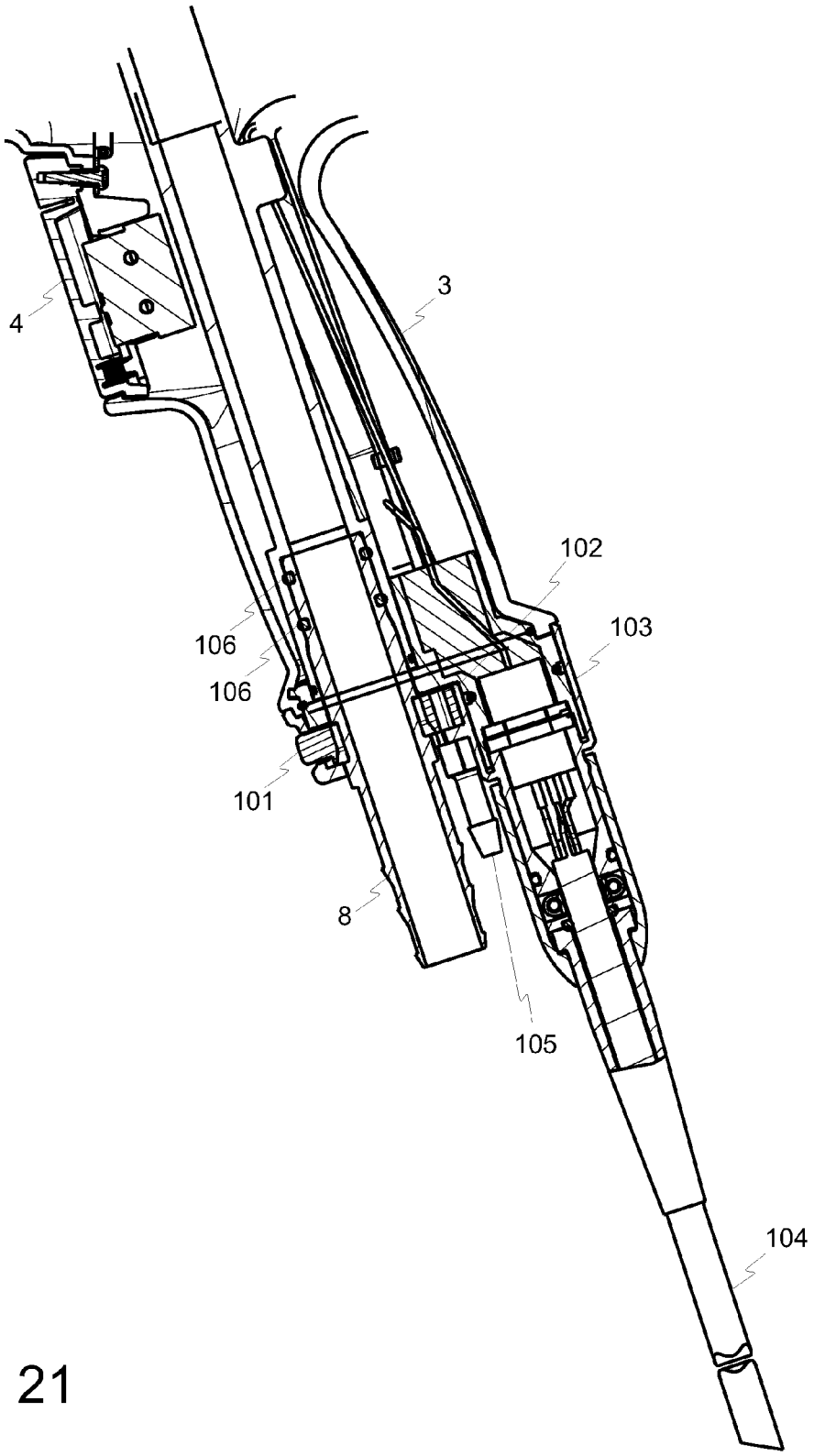
FIG. 21 shows a longitudinal sectional view of the gun grip with the powder tube connection, the metering air connection and the electrical connection.
Figure 22:
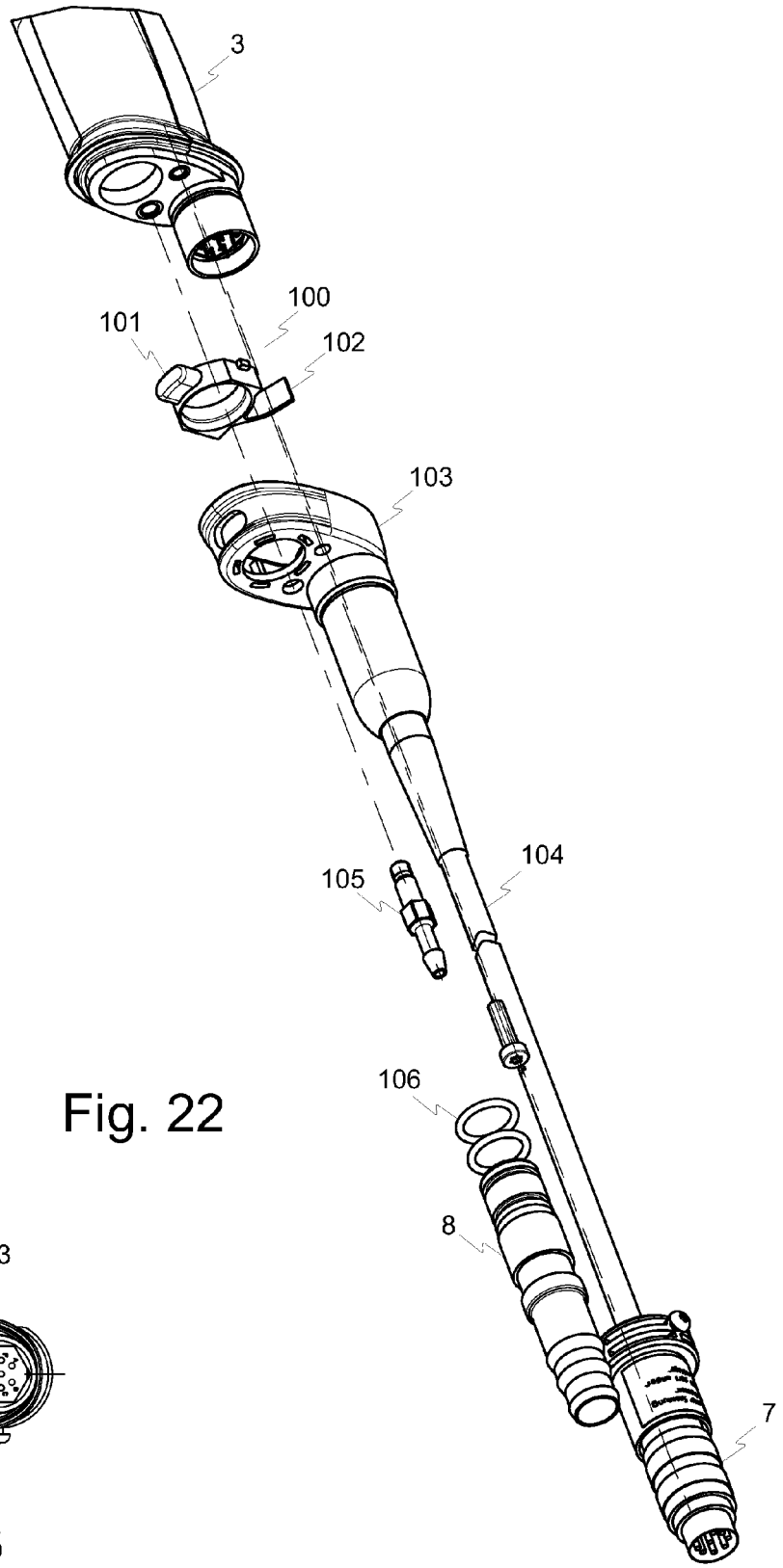
FIG. 22 shows an exploded view of the lower part of the gun grip with the various connections.
Figure 23:
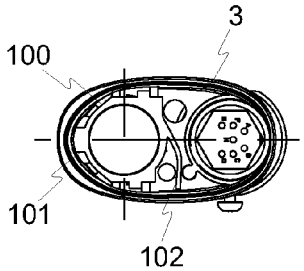
FIG. 23 shows a cross-sectional view of the gun grip in the region of the connection housing.

FIG. 21 shows a longitudinal sectional view of the gun grip 3 with the powder tube connection 8, the atomising air connection 105 and the electrical connection 7. FIG. 22 shows an exploded view of the lower part of the gun grip 3 with the different connections. FIG. 23 shows a cross-sectional view of the gun grip 3 in the region of the connection housing 103. The connection housing 103 carries the connection cable 104 with the electrical connection 7, the tube nipple 105 and the powder connection 8. The connection housing 103 is generally screwed to the gun grip 3. The powder connection 8 can be locked to the gun grip 3 or removed therefrom with the aid of a slide 100. In order to lock the powder connection 8 to the gun grip 3, merely the powder connection 8 is pressed into the opening, provided for this purpose, in the gun grip 3. The powder connection 8 then latches in place. In order to remove the powder connection 8, the push button 101 of the slide 100 is pressed. This then releases the powder connection 8. The powder connection 8 can then be removed. The slide 100 is equipped with a spring 102, such that the slide 100 is pressed into a defined position when the push button 101 is not pressed.

The above description of the exemplary embodiments according to the present invention is used merely for illustrative purposes and not for the purpose of limiting the invention.

Various changes and modifications are possible within the scope of the invention without departing from the scope of the invention and equivalents thereof. For example, the various baffle cones shown in FIG. 19 can thus be fitted onto the electrode holder 900 shown in FIG. 7. In addition, the individual component parts can also be combined with one another in a manner different from that shown in the figures.

The spray gun 1 can also be formed as an automatic gun. In this case, the hand grip 3 is omitted. An automatic gun is understood to mean a spray gun that is not held by hand, but for example is fastened or fixedly installed on a robot or a linear guide.

The spray gun 1 may also be formed as a powder beaker gun. In this case, a powder beaker including a powder injector is attached directly to the spray gun, for example thereabove, instead of the powder tube connection 8.

A gun extension may also be arranged between the downstream portion 2.1 of the gun housing 2 and the electrode holder. The gun extension comprises a powder tube. The upstream end thereof can be screwed onto the thread 2.2 of the gun housing. The downstream end of the powder tube is constructed similarly to the downstream portion 2.1 and receives the electrode holder 9 and the nozzle 5. The cap nut is screwed onto the downstream end of the gun extension. For example, relatively large indentations in a workpiece can be coated with an extended spray gun of this type.

LIST OF REFERENCE SIGNS

1 powder spray gun
2 gun housing
2.1 downstream portion of the gun housing
2.2 outer thread
2.3 socket
3 grip
4 trigger
5 spray nozzle
6 cap nut
7 electrical connection
8 powder connection
9 electrode holder
10 powder channel in the electrode holder
11 electrode
12 electrode channel
13 annular groove
14 powder tube
15 guide lug
16 snap-in groove
17 wall
18 wall
19 contact ring
20 inner ring
21 inner wall of the outer ring 26
22 outer wall of the inner ring 20

23 retaining web
24 axial seal
25 wall
26 outer ring
27 contact pin
28 spring
29 resistor
30 wedge
50 nozzle slit
51 powder channel in the spray nozzle
52 sleeve
53 snap-in groove in the spray nozzle
54 latching groove
55 slit
56 wall of the snap-in groove
57 wall of the snap-in groove
60 snap-in hook
61 web for the labyrinth
62 inner thread
63 slit
70 tool
71 gripper
72 receptacle
73 annular receptacle
74 lug
75 baffle plate
76 baffle plate
77 baffle plate
78 clamping ring
79 O-ring
80 baffle plate housing
80.1 bore in the baffle plate housing
91 channel for the resistors
100 slide
101 push button
102 spring
103 connector housing
104 connection cable
105 tube nipple
106 O-ring
500 round jet nozzle
501 powder channel in the spray nozzle
530 snap-in groove
550 slit
560 wall of the snap-in groove
570 wall of the snap-in groove
900 electrode holder
911 electrode
912 electrode channel
913 receptacle in the electrode channel
B width
L longitudinal axis
T depth
P direction of flow of the powder
BK width of the wedge
DK thickness of the wedge
LK length of the wedge
R radius of the wedge

The invention claimed is:

1. An electrode holder for a powder spray gun operable at high-voltage, wherein a powder channel is provided, wherein a web for holding a high-voltage electrode is arranged in the powder channel, wherein the electrode holder has an annular groove arranged concentrically with the powder channel and the annular groove comprises two opposing side walls and is open towards the downstream side of the electrode holder, wherein an annular web of a cap nut protrudes into the annular groove when the cap nut locks the electrode holder into place, thereby forming an electrical resistive labyrinth configured to isolate the high voltage, and wherein the electrode holder has one or more lugs which interlock with one or more slits of a jet nozzle.

2. The electrode holder according to claim 1, wherein the annular groove has a width and depth such that, when the annular web of the cap nut protrudes into the annular groove, an air gap is formed between the walls of the annular groove and the web.

3. The electrode holder according to claim 1, wherein the electrode holder comprises a snap-in groove provided outside the powder channel, wherein the snap-in groove comprises two opposing side walls and is provided in order to form a snap-fit connection together with a snap-in hook of a cap nut, which is used to lock the electrode holder.

4. The electrode holder according to claim 3, wherein the snap-in groove is open in the radial direction.

5. The electrode holder according to claim 4, wherein a guide lug extending in the axial direction is provided on the outer face of the powder channel, and wherein the snap-in groove is recessed into the guide lug.

6. The electrode holder according to claim 3, wherein an axial seal arranged concentrically with the powder channel is provided.

7. The electrode holder according to claim 3, wherein an electrically conductive contact ring is provided.

8. The electrode holder according to claim 7, wherein a channel is provided, in which a plurality of resistors are arranged, via which the contact ring is connected to the high-voltage electrode.

9. A powder spray gun operable at high voltage, wherein an electrode holder according to claim 3 is provided, and wherein the cap nut with a snap-in hook is provided, which forms a snap-fit connection together with the snap-in groove in the electrode holder.

10. The electrode holder according to claim 1, wherein a wedge is provided, which can be fitted onto the upstream end of the web for holding said high-voltage electrode.

11. The electrode holder according to claim 10, wherein the wedge has a width of 13.2 mm with a tolerance of +/−0.2 mm.

12. The electrode holder according to claim 10, wherein the wedge has a length between 10 and 20 mm.

13. A jet nozzle for a powder spray gun operable at high voltage, wherein the jet nozzle comprises a powder channel which discharges on the downstream side into a nozzle opening, wherein the jet nozzle comprises a radial outwardly open snap-in groove in order to form a snap-fit connection together with a snap-in hook of a cap nut, which is used to lock the jet nozzle, and wherein the snap-in groove is formed such that, when the jet nozzle sits on an electrode holder, which likewise has a snap-in groove, the walls of the snap-in groove in the jet nozzle are not offset axially with respect to the walls of the snap-in groove in the electrode holder.

14. The jet nozzle according to claim 13, wherein, on the upstream side, a slit is provided, into which a guide lug of an electrode holder protrudes when the jet nozzle sits on the electrode holder, and wherein the slit extends from the upstream end of the powder channel, beyond the snap-in groove.

15. The jet nozzle according to claim 13, wherein a displaceable sleeve is provided, and wherein a latching mechanism is provided, with which the sleeve can latch on the powder channel.

16. The powder spray gun according to claim 13, wherein the snap-in hook of the cap nut forms a snap-fit connection together with the snap-in groove in the jet nozzle.

* * * * *